United States Patent [19]

Heise et al.

[11] Patent Number: 4,530,183

[45] **Date of Patent: * Jul. 23, 1985**

[54] REVOLVING DOOR SYSTEM

[75] Inventors: Stanley R. Heise, Blaine; Michael D. Blackston, Brooklyn, both of Minn.; Michael B. Zekich; John L. B. Parselle, both of Pasadena, Calif.

[73] Assignees: Heise Manufacturing Co., Inc., Minneapolis, Minn.; Related Energy & Security Systems, Inc., Evansville, Ind.

[ * ] Notice: The portion of the term of this patent subsequent to Oct. 9, 2001 has been disclaimed.

[21] Appl. No.: 636,576

[22] Filed: Aug. 1, 1984

Related U.S. Application Data

[63] Continuation of Ser. No. 353,165, Mar. 1, 1982, Pat. No. 4,475,308.

[51] Int. Cl.[3] ..... E05D 15/02

[52] U.S. Cl. ..... 49/42; 49/43; 109/8

[58] Field of Search ..... 49/28, 32, 42–44; 109/3, 8

[56] References Cited

U.S. PATENT DOCUMENTS

| | | | |
|---|---|---|---|
| 3,285,209 | 11/1966 | Pace | 49/42 X |
| 4,060,935 | 12/1977 | Miller et al. | 49/42 X |
| 4,063,519 | 12/1977 | Pretini | 49/42 X |
| 4,295,297 | 10/1981 | Carroll et al. | 49/42 |
| 4,341,165 | 7/1982 | Calandritti et al. | 49/42 X |
| 4,475,308 | 10/1984 | Heise et al. | 49/42 |

FOREIGN PATENT DOCUMENTS

| | | | |
|---|---|---|---|
| 2803765 | 8/1979 | Fed. Rep. of Germany . | |
| 2025513 | 1/1980 | United Kingdom | 49/42 |

*Primary Examiner*—Kenneth Downey

*Attorney, Agent, or Firm*—Merchant, Gould, Smith, Edell, Welter & Schmidt

[57] ABSTRACT

A controller driven revolving door system has facing spaced apart curved panels partially enclosing three equiangularly spaced center shaft coupled wings and defining entry and exit openings. The controller automatically selectively directs traffic flow through the entry and exit openings and is responsive to a microwave motion detector at the entry and a mat switch in a quarter-point position accessable to the exit. A DC motor is coupled by a gearing assembly to the center shaft. The controller monitors current passing through the motor windings sensing shaft rotation. Responsive to the mat switch, the controller applies a resistive load to the DC motor windings to regeneratively brake the rotation of the door. The controller thereafter reverses the polarity of the motor windings causing the door to rotate in a reverse direction and back any individual out of the exit area. Drum edge switches on the curved panels sense interference with foreign objects to cause the controller to regeneratively brake, halting rotation of the center shaft. A handicapped person switch is provided to reduce motor current and reduce shaft rotation speed.

9 Claims, 8 Drawing Figures

REVOLVING DOOR SYSTEM

This is a continuation of application Ser. No. 353,165, filed Mar. 1, 1982, now U.S. Pat. No. 4,475,308.

BACKGROUND OF THE INVENTION

1. Field of the Invention

This invention pertains to revolving doors. More particularly this invention relates to revolving door security and safety systems.

2. Description on the Prior Art

Automatic and electrical revolving doors have been in use for many years. Electrical revolving doors facilitate rotation particularly in applications where the stack pressure, that is, the pressure differential from the interior to exterior space on opposite sides of the revolving door, is significant. In some applications, mechanical gearing makes manual rotation difficult. Braking systems have also been used in connection with revolving doors for use in emergency events and to prevent unauthorized passage.

Security is often important to prevent unauthorized access to various areas. In some situations, it is necessary to prevent exiting from the revolving door after one has already entered into a security region. It would be desirable to provide such selectively directed access without the necessity and costs of guard stations.

SUMMARY OF THE INVENTION

A revolving door system in accordance with this invention generally comprises a multiple wing revolving door, preferably having three wings disposed radially about a shaft with means to prevent traffic flow in other than a forward direction. A detector responsive to a person approaching the drum of the revolving door from an exit is coupled to a controller to brake rotation of the shaft, followed by a rotation in the reverse direction to back the individual out of the drum.

In a more specific example, a DC motor powers the shaft and a resistive load is applied by a controller to windings of the motor to cause regenerative braking and halting shaft rotation. Means are provided for braking of the shaft upon sensing interference with a foreign object.

Additional features in accordance with the invention include current monitoring of the motor to determine shaft rotation. Indexing is provided to define the end of a rotation cycle irrespective of the starting position of the shaft. A high gear reduction causes an enhanced dynamic breaking effect. On the edge of the drum panels, a ribbon switch senses interference of a foreign object to cause the shaft to brake. A time delay interval occurs before a reverse rotation cycle, and a forward cycle is allowed to continue after a reversing cycle is completed.

BRIEF DESCRIPTION OF THE DRAWINGS

A better understanding of the invention may be had by reference to the specification taken in connection with the following drawings in which.

DETAILED DESCRIPTION

Figure 1:
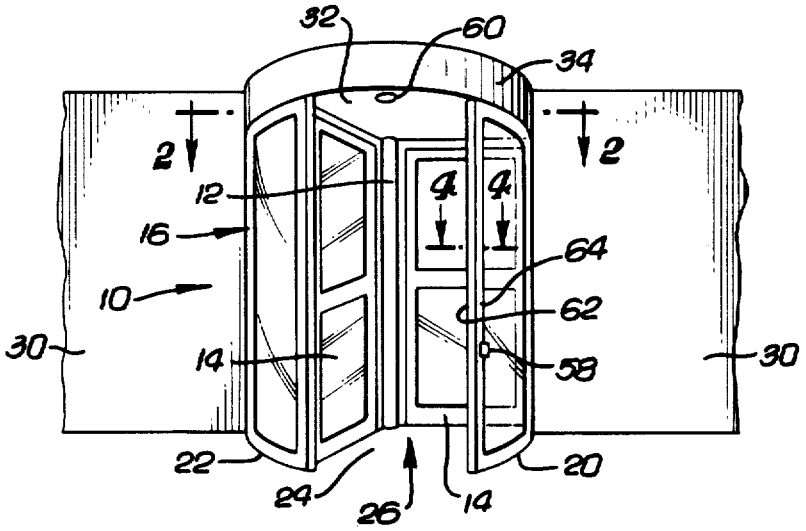
FIG. 1 is a perspective view of a revolving door system in accordance with this invention.

With particular reference to FIG. 1, a revolving door system 10 in accordance with this invention generally comprises an upright vertical center shaft 12 defining an upright axis and three spaced apart upright panels or wings 14 disposed circumferentially equiangularly about and rotatable about the axis, with the shaft 12. A drum 16 is provided for covering the wings 12. The drum 16 includes facing substantially semicircular or curved panels 20, 22 partially enclosing the wings 14 and the shaft 12 and defining a partially enclosed generally circular region 24. The panels 20, 22 are spaced apart to define opposing entry and exit openings 26, 28. Extending outwardly on opposite sides of the curved panels 20, 22 are front walls 30 for preventing access. The three wings 14 of the revolving door 10 divide the generally circular region 24 between the curved panels 20, 22 into three moveable cylindrical segments having a cross section of constant equal area. The shaft 12 and thus the wings 14, though rotatable define into a quarter-point position when any two of the wings 14 enclose a curved panel 20, 22. A mat switch 29 is disposed on the floor within the confines of the quarter-point position bounded by the panel 22 and a mat switch 31 is disposed on the floor within the confines of the quarter-point position bounded by the panel 20. The mat switch 29 senses the presense of an individual seeking entry from the exit opening 28. So that the door may be used in a reverse mode, the mat switch 31 also senses the presense of an individual seeking improper access, when the entry 26 and exit 28 are reversed. As a result of the wing spacing an individual entering one segment is separated from any individual in either adjacent second segment.

Figure 2:
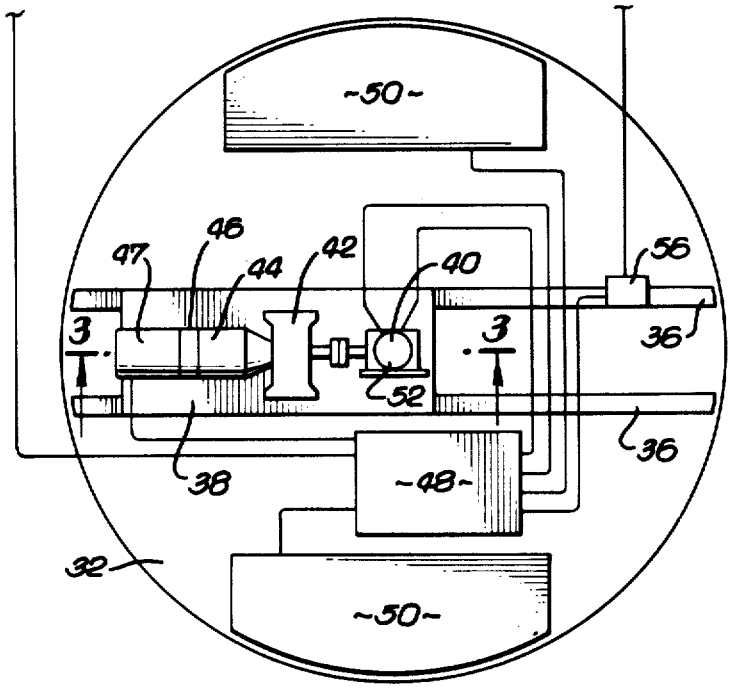
FIG. 2 is a cross-sectional plan view taken along lines 2—2 of FIG. 1.
Figure 3:
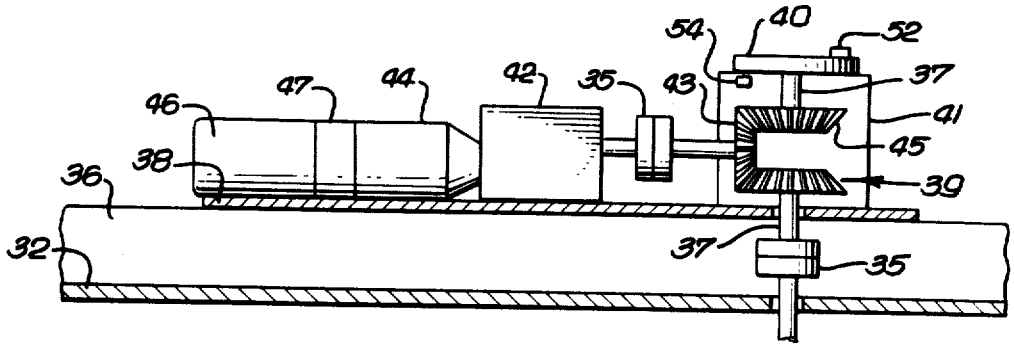
FIG. 3 is a diagrammatic cross-sectional elevational view taken along lines 3—3 of FIG. 1.

The drum 16 comprises a ceiling 32 and a cylindrical vertical facia 34 extending upward from the ceiling 32. As best viewed in FIG. 2, a pair of parallel spaced apart longitudinal rails 36 extend across the ceiling 32 about the diameter of the ceiling 32. A rectangular plate 38 disposed parallel to the ceiling 32 is joined to the rails 36. As best viewed in FIG. 3, the shaft 12 extends through the ceiling 32. A coaxial coupling 35 couples a rod 37 to the shaft 12. The rod 37 is coupled to a right angle gear assembly 39. A different rod 37 extends upward from an upper bevel gear 45 of the right angle gear assembly 39, and terminates in a circular plate 40 above a support plate 41. The circular plate 40 is rotatable with the rod 37, and in this example, at the same speed as the shaft 12. The right angled gear assembly 39 includes a central bevel gear 43 which is coupled by another coaxial coupler 35 to a gearing assembly 42, which in turn is coupled to a motor reducer 44. An electromechanical brake assembly 47 couples the motor reducer 44 to a motor 46. The gearing provided by the right angle gear assembly 39, the gear box 42 and the motor reducer 47 typically provides a motor to center shaft gear ratio on the order of 150:1. The motor 46 is typically a ¼ horsepower motor with a permanent magnet field, though the size depends upon the particular installation. The motor 46 operates in connection with the application of a resistive load to regeneratively brake the motor 46 in most situations. The combination of the high gear ratio along with regerative or dynamic braking provides sufficient resistance to movement of the wings 14 for all practical purposes to prevent manual rotation when regeneratively braked. This results in an economical controller and braking arrangement. However, in installations requiring exceptionally high security, an electromagnetic brake, such as brake 47, may also be used to assure that the door is prevented from movement when actuated.

A controller 48 located above the ceiling 32 is electrically coupled to and controls the motor 46, a dynamic brake, when used, and a pair of light boxes 50 for illuminating the door or lighting signs. Three magnets 52 are disposed on the circular plate 38. A pair of proximity switches 54 are coupled adjacent the magnet 52 on the support plate 41 to sense the position of the shaft 12. The first proximity switch 54 is used prior to the end of a cycle to direct the shaft 12 to slow down. The other proximity switch 54 defines the end of a cycle, causing the motor 46 to brake. Position sensing is independent of the starting location of the shaft 12 and the magnets are positioned so that rotation of the wings will always terminate in a quarter point position. The controller 48 receives power from an electric box 56 on one of the rails 36.

A handicap pushbutton switch 58 is disposed adjacent the opening 26 and exit 28. The switch 58 is coupled to the controller to cause the running speed of the motor 46 to be reduced when actuated.

A motion detector 60 such as a microwave detector is disposed on the facia 34 adjacent the entry 26 to sense the presense of a person in the region of the entry 26. An example of a suitable detector is that of Model D7 provided by Microwave Sensors of Ann Arbor, Mich. Typically the detector defines a region whereby the movement of an object within the general confines of the defined region alters a very low power broad microwave beam, which senses the movement and actuates a relay.

Figure 4:
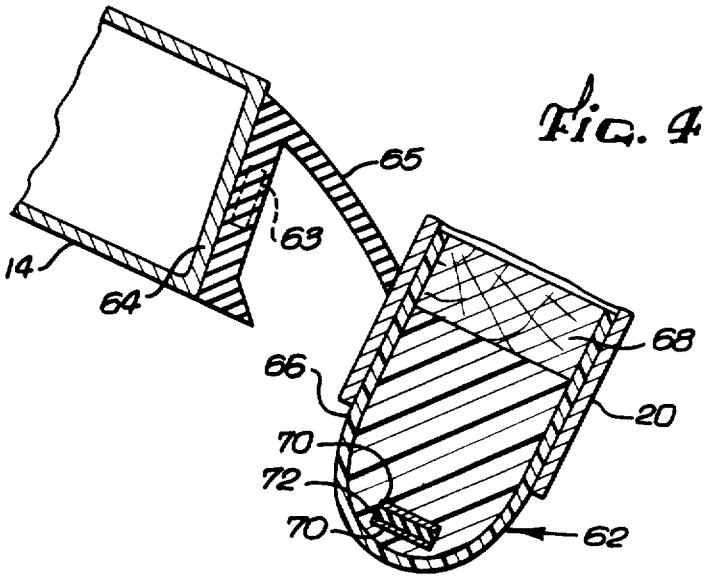
FIG. 4 is a detailed cross-sectional view taken along lines 4—4 of FIG. 1.
Figure 6:
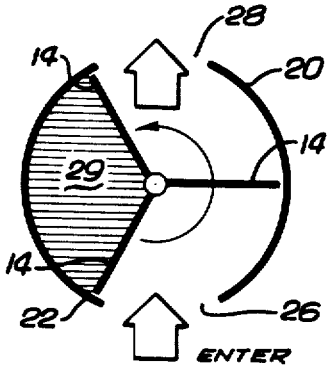
FIG. 6 is a diagrammatic plan view of the invention depicted in FIG. 1.

With particular reference to FIGS. 1 and 4, a drum edge switch 62 is disposed along the vertical edges 64 of the curved panels 20, 22. The drum edge switches 62 sense physical interference between the drum edge 64 and the wings 14, such as a human limb or object. The drum edge switches 62 comprise a curved rubber extrusion 66 vertically disposed along the panel edge 64 and joined to a wooden support block 68 adjacent the vertical edge of the curved panels 20, 22. A pair of narrow vertically disposed longitudinal metal plates 70 separated by an apertured thin (typically less than 2 mm.) rubber strip 72 are glued with a silicone compound to the inner surface of the rubber extrusion 66. The interior space of the rubber extrusion is filled with foam rubber 74 to give it form. Similar edge switches 62 may be provided for vertical edges of the wings 14 in some examples of the invention. Similarly, door edge switches 63 may be disposed along edges 64 of the wings 14 where a weatherstripping 65 is shown in FIG. 4.

In some examples of the invention a lock 80 and remote switches 81 are available to prevent rotation of the shaft 12, and in other situations to allow remote actuation, bypass and reversing rotation of the shaft 12.

Figure 5:
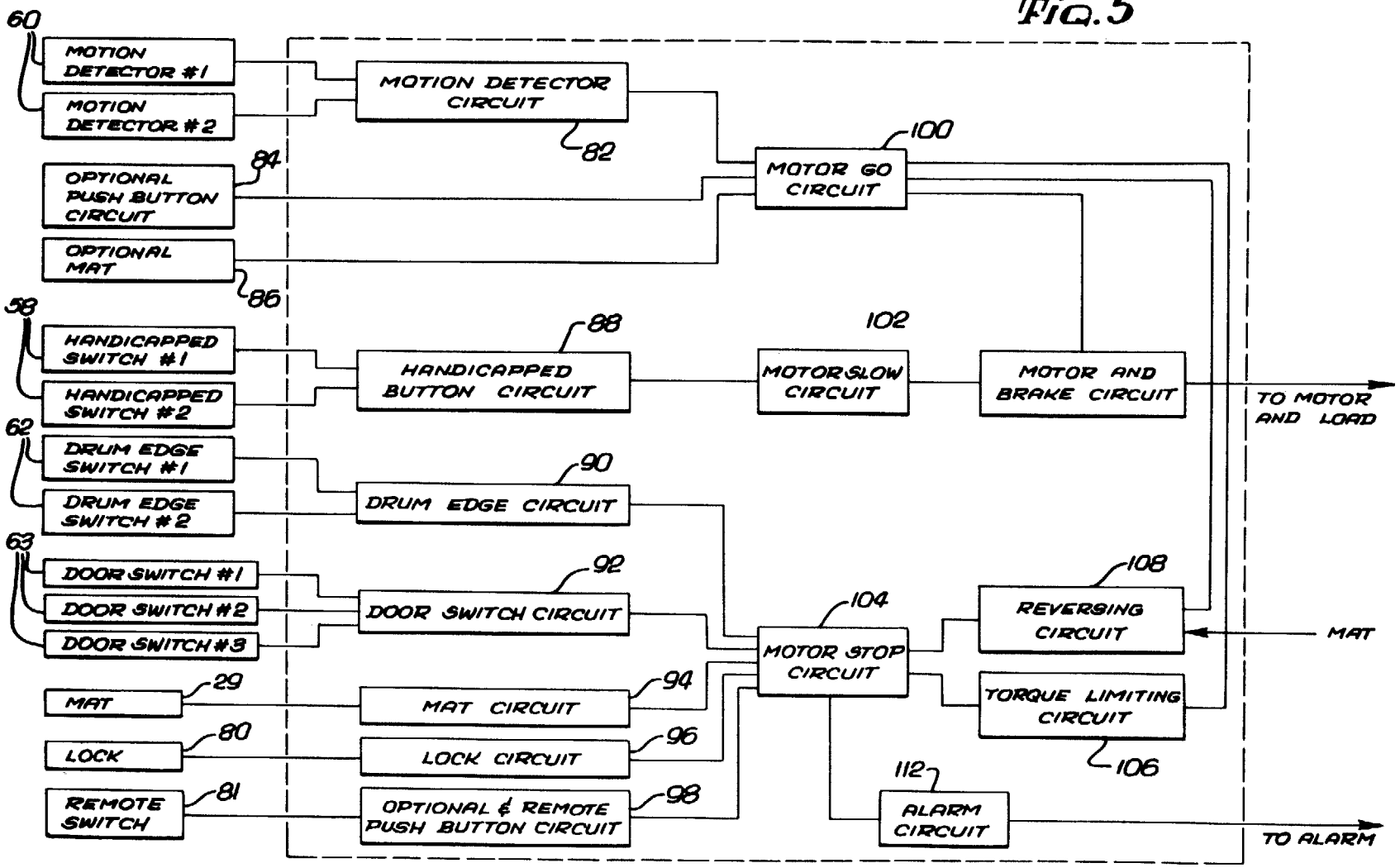
FIG. 5 is a block diagram of the invention depicted in FIG. 1.

With particular reference to FIG. 5, the controller 48 comprises a plurality of logic circuits coupled to control the motor 46. In particular, a motion detector circuit 82 is coupled to the motion detectors 60 for sensing the presense of an individual in the proximity of the entry opening 26. It should be recognized that in some situations, the entry and exit openings 26, 28 may be reversed. Thus in the evening, one opening may provide an entry, and in the morning, the same opening may provide an exit. In some embodiments, the mat 31 or a separate mat in front of the opening 26 may be used to detect the presence of an individual in the entry opening 26. A push button circuit 84 and an optional mat circuit 86 may be used to sense the actuation of these devices.

A handicapped button circuit 88 is provided to sense the actuation of either of the handicapped switches 58 by handicapped persons to actuate the motor 46 to rotate a slower than normal speed or typically, at half the normal speed.

Coupled to the drum edge switches 62 is a drum edge circuit 90. Similarly, a door edge circuit 92 is provided to sense actuation of door edge switches to cause the motor 46 to stop rotation. A mat circuit 94 is provided for sensing the actuation of the mat 29. This indicates the presense of an individual attempting to enter improperly and thus is coupled to cause a stoppage of the motor 46. Similarly, the lock circuit 96 responsive to the lock switch 80 and optional remote push button circuit 98 responsive to the remote switch 81 are also responsive to provide an indication to stop rotation of the motor 46.

A motor go circuit 100 is coupled to and is responsive to the motion detector circuit 82, the optional push button circuit 84 and the optional mat circuit 86. The motor go circuit 100 provides an output indication for initiating a rotation of the motor 46 upon receipt of an indication from the motion detection circuit 82, the optional push button circuit 84 or the optional mat circuit 86.

A motor slow circuit 102 is responsive to the handicapped circuit to cause a reduced speed actuation of the motor 46. The slow mode of rotation may also be used at the end of a forward rotation cycle, and in a reversing mode.

A motor stop circuit 104 is coupled to the drum edge circuit 90 to provide an indication to cause the motor to stop rotating in response to interferences with the door. Presense of an individual on the mat will also will cause an indication signal to lock up the motor. Additionally, the stop circuit 104 is coupled to the lock circuit 96 and the optional remote push button circuit 98 to sense cause the stop circuit 104 to provide a stopping indication output.

A torque limiting circuit 106 is coupled to the stop circuit 104. The torque limiting circuit 106 senses the current through the windings of the DC motor 46 and thus at the same time indirectly measures the rotation speed of the shaft 12. The torque limiting circuit is coupled to the motor go circuit 102 to enable rotation of the motor 46 when the wings 12 are manually rotated, such as in excess of about 2 RPM. The torque limiting circuit 106 is coupled to the motor stop circuit 104 to brake the shaft 12 rotation by applying a load to the windings of the DC motor 46, when rotation in the reverse direction is attempted.

A reversing circuit 108 is coupled to the motor stop circuit 104. The purpose of the reversing circuit 108 is to reverse the polarity of current applied to the motor in various situations. Reversal is required to back an individual out of the drum 16 when approaching from the exit 28 in response to actuation of the mat switch 29 and the mat sensing circuit 94.

With particular reference to FIGS. 1, 2, 3, 4, 5 and 6, the revolving door system 10 is initially operated by the motion detector 60 sensing the presence of a person adjacent the entry 26. The motion detector 60 then causes the motion detection circuit 82 to provide an indication to the motor go circuit 100. The motor go circuit 100 causes the motor 46 to begin rotation, causing the gear box 42 to rotate the center shaft 12 and thus accelerating the revolving door system 10 to the normal run speed. Should the handicapped push button switch 58 be pressed prior to the detection of a person by the motion detector 60 or during rotation of the shaft 12, that indication will be sensed by the handicapped push button circuit 88 causing the motor slow circuit 102 to reduce the current to the motor 46. The wings 14 will then rotate at half the normal speed.

If a person is not detected by the microwave sensor, the doors can be manually pushed. When the door reaches a speed of 2 RPM, the motor 46 will generate a current sensed by the torque limiting circuit 106 enabling the motor go circuit 100 to cause the motor 46 to automatically start rotation.

Once a rotation of the shaft 12 has been initiated, it will continue over a span of 120°. As one of the magnets 52 closes the first proximity switche 54, an indicator is provided to the motor 46 to slow down. The second proximity switch is then actuated by the same magnet 52 and causes the current in the motor 54 to be turned off. Irrespective of the position of the wings 14 at the beginning of a cycle, the magnets 52 and proximity switches 54 index the wing 14 positions so that the shaft will always stop at a quarter-point position enclosing the panel 22. It should be recognized that in some examples, it may be desirable to maintain a forward rotation of the door, particularly during busy hours, continually at at least the slower handicapped speed.

Interference with a foreign object is sensed by the drum edge switch 62. The interference of an object with the rubber extrusion 66 causes a contacting of the metal plates 70 along the apertures of the rubber strip 72. This closure of the drum edge switch 62 causes an indication to be provided by the drum edge circuit 90 to cause the motor stop circuit 104 to brake the motor 46. Braking will be maintained for about 5 seconds until after the drum edge switch 62 has been cleared, after which the door system 10 will automatically continue its forward rotation.

Figure 7:
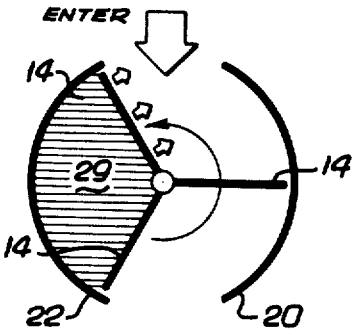
FIG. 7 is a further diagrammatic plan view of the invention depicted in FIG. 1.

With reference to FIG. 5 and FIG. 7, when the exit mat on the opposite side of the door system 10 that is being used isg used is stepped on, the mat circuit 94 causes the motor stop circuit 104 to regeneratively brake for a quick stop. The alarm circuit 112 will energize and remain energized as long as the mat switch 29 is on and enabled. After about one second, the reversing circuit 108 is actuated and the door system 10 automatically reverses direction and accelerates to the handicapped speed until the door has reached a quarter-point position as sensed by the proximity switches 54. It then stops and restarts automatically in the forward direction at the original speed, the motor go circuit 100 otherwise being enabled. Thus, if an individual attempted to enter the exit 28 when another individual was seeking proper entry, both individuals would be backed out, after which the individual seeking proper entry could then pass through.

Should an individual seek to reverse the rotation of the door, entering from the exit 28, the torque limiting circuit 106 will sense a current flow of reversed polarity, and will direct the motor and brake circuit 110 to regeneratively brake. The greater the force applied to the wings 14, the greater the resistance from regenerative braking.

In some situations it may be desirable to have more than three wings on the revolving door, though a preferred example here does show three wings. By limiting the dimensions, the possibility of piggybacking two people through the same revolving door section can be eliminated for all practical purposes.

Figure 8:
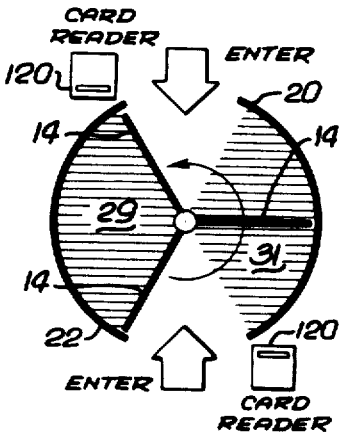
FIG. 8 is a diagrammatic plan view of a different embodiment of the invention depicted in FIG. 1.

In some high security situations, a card reader 120 may be incorporated to limit access through the entry 26, as shown in FIG. 8. The card reader 120 may be substituted for the motion detector 60. A second card reader 120 at the exit 28 may be used to allow two way traffic or to reverse entry and exits 26, 28.

Thus a revolving door system has been shown which prevents unauthorized exiting and causes individuals who have attempted wrongful entry to be carefully removed from the door without the necessity or presence of a guard.

While the invention has been shown and described with respect to preferred examples thereof, it will be understood that changes in the system may be made within the scope of the claims without departing from the spirit and scope of the invention.

What is claimed is:

1. A security door system for permitting passage of persons therethrough in one authorized direction while preventing persons from trying to pass therethrough in the other unauthorized direction, comprising:

a central axis of rotation;

a plurality of at least 3 wings circumferentially spaced about and rotatable about the axis;

a pair of upright opposing curved panels disposed in facing spaced apart relationship to define a partially enclosed region bounding the wings and defining opposing first and second openings;

electrically operated means for rotating the wings about the axis in first and second rotating directions;

means for actuating the door to turn in a first rotating direction to permit an authorized person to pass through the system;

means for detecting the presence of a person attempting to pass through the system in the opposite unauthorized direction.

means responsive to said detecting means for automatically stopping the rotation of the door and reversing its rotating direction before the unauthorized passage is completed to back the person out toward their point of entry; and means for automatically re-enabling the rotation of the door in the first rotating direction when the unauthorized person is no longer detected, said stopping, reversing and re-enabling functions being performed by said system without human intervention.

2. A system according to claim 1 wherein said electrical rotating means includes circuitry for effecting regenerative braking when the wings are stopped so that the door may not be moved when the system is not rotating under power.

3. A system according to claim 1 wherein said electrical rotating means includes circuitry for sensing manual rotation of the wings about the axis in an authorized direction and initiating powered response thereto while detecting attempted manual rotation in the opposite unauthorized direction and causing regenerative braking in response thereto.

4. A system according to claim 1 wherein the electrical rotating means has a first speed and second slower speed which may be selected.

5. A system according to claim 1 wherein said wings rotate about the axis at said second speed when rotating in the reverse direction.

6. A system according to claim 1 in which the panels have vertical upright edges movable adjacent the curved panels, the panels including an edge switch for sensing the presense of foreign objects in the vicinity of the edge and the interior of the curved panels, the edge switch coupled to the electrical rotating means for braking the rotation of the wings upon sensing a foreign object in the vicinity of the edge.

7. A system according to claim 1 wherein said electrical rotating means includes means to rotate the wings about the axis at a first speed and delay means for providing a time interval between the stopping of the wings in response to the presense of an attempted unauthorized passage and a reverse rotation of the wings.

8. A security door system for permitting passage of persons therethrough in one direction while ejecting persons trying to pass therethrough in the other direction, comprising:

a central axis of rotation;

a plurality of at least 3 wings circumferentially spaced about and rotatable around the axis;

a pair of upright opposing curved panels disposed in facing spaced apart relationship to define a partially enclosed region bounding the wings and defining opposing first and second openings;

electrically operated means for rotating the wings about the axis in first and second rotating directions;

means for actuating the door to turn in a first rotating direction to permit an authorized person to pass through the system;

means for monitoring the rotation and position of the wings and including index means for stopping the rotation of the wings about the axis at plural predetermined positions defined by quarter-point positions of the wings and panels;

means for detecting the presence of a person attempting to pass through the system in the opposite unauthorized direction;

means responsive to said detecting means for automatically stopping the rotation of the door and reversing its rotating direction to a point not further than the quarter-point position before the unauthorized passage is completed to back the person out toward their point of entry; and means for automatically re-enabling the rotation of the door in the first rotating direction when the unauthorized person is no longer detected, said stopping, reversing and re-enabling functions being automatically performed by said system without human intervention.

9. A revolving door system comprising:

a central axis of rotation;

a plurality of wings circumferentially spaced about and rotatable around the axis;

a pair of upright opposing panels disposed in facing spaced apart relationship to define a partially enclosed region bounding the wings and defining opposing first and second openings;

means for rotating the wings about the axis including a DC electric motor; and controller means for actuating the rotating means in a forward rotation direction including means for coupling the motor in a regenerative mode to brake the rotation of the wings and in which the controller provides for an initial actuation of the wing rotation at a first rotational speed, and means for actuating the wing rotation at a second rotational speed less than the first rotational speed;

first sensing means for detecting the presence of a person entering the partially enclosed region from the first opening, the controller means responsive to the first sensing means for stopping rotation of the rotating means in the forward rotational direction and for thereafter actuating the rotating means in a direction opposite the first direction;

second sensing means responsive to a person at the second opening to initiate a normal rotation cycle;

whereby a person attempting to pass from the first opening to the second opening is prevented from doing so and is forced back to the first opening.

* * * * *